US006127782A

United States Patent [19]

Flory, IV et al.

[11] Patent Number: 6,127,782

[45] Date of Patent: Oct. 3, 2000

[54] EXTERNALLY MOUNTABLE DISCHARGE LAMP IGNITION CIRCUIT HAVING VISUAL DIAGNOSTIC INDICATOR

[75] Inventors: Isaac L. Flory, IV, Blacksburg; Christopher Allen Hudson, Christiansburg, both of Va.

[73] Assignee: Hubbell Incorporated, Orange, Conn.

[21] Appl. No.: 09/172,677

[22] Filed: Oct. 15, 1998

[51] Int. Cl.[7] ..... H01J 1/60

[52] U.S. Cl. ..... 315/129; 174/50.52; 174/52.1; 362/368

[58] Field of Search ..... 315/129, 130, 315/135, 127, 128, 289, 290, 276, DIG. 5; 324/463; 174/50, 50.51, 50.52, 52.1, 53; 362/362, 368, 378

[56] References Cited

U.S. PATENT DOCUMENTS

| | | | |
|---|---|---|---|
| 2,998,545 | 8/1961 | Smyth . | |
| 3,012,090 | 12/1961 | Robbins | 174/52 |
| 3,735,378 | 5/1973 | McNamee | 340/251 |
| 4,068,216 | 1/1978 | Brouwer et al. | 340/168 |
| 4,222,047 | 9/1980 | Finnegan | 340/641 |
| 4,318,031 | 3/1982 | Lonseth et al. | 315/133 |
| 4,496,905 | 1/1985 | Forte et al. | 324/414 |
| 4,730,163 | 3/1988 | Santos | 324/414 |
| 5,296,815 | 3/1994 | Conway et al. | 324/414 |
| 5,321,338 | 6/1994 | Nuckolls et al. | 315/290 |
| 5,323,116 | 6/1994 | Atria | 324/511 |
| 5,557,207 | 9/1996 | Duve | 324/414 |
| 5,614,790 | 3/1997 | Fleck, Sr. et al. | 315/135 |

OTHER PUBLICATIONS

Hubbell Lighting Buyers Guide, Nite–To–Lite® Series with Twist–Lock® Photocontrol Receptacle, p. 262, ©1992, Hubbell Incorporated.

*Primary Examiner*—Don Wong
*Assistant Examiner*—Thuy Vinh Tran
*Attorney, Agent, or Firm*—Jerry M. Presson; Stacey J. Longanecker

[57] ABSTRACT

An ignitor and ignitor monitoring device is provided which is externally and detachably mounted to a high intensity discharge (HID) luminaire. The ignitor monitoring device provides a visual indication of whether or not the ignitor of the lamp in the HID luminaire is functioning. If the lamp is not on and the indicator is activated, sufficient open circuit voltage is present to operate the ignitor, the ballast in the luminaire is most likely functioning properly, and power is present to operate the luminaire. A service person can assume that the lamp is defective and can replace the lamp as a first attempt to correct the problem with the luminaire. If the lamp is off and the indicator is also not operating, the luminaire is not operating for any of a number of reasons such as a defective ignitor, a defective ballast capacitor, a defective lamp or loss of supply voltage from the power source. A service person can replace the ignitor in a first attempt to repair the luminaire. Replacing the ignitor is the simplest initial repair option since the ignitor is externally mounted on the luminaire.

9 Claims, 6 Drawing Sheets

EXTERNALLY MOUNTABLE DISCHARGE LAMP IGNITION CIRCUIT HAVING VISUAL DIAGNOSTIC INDICATOR

FIELD OF THE INVENTION

The invention relates to an ignitor and ignitor indicator for facilitating the troubleshooting of a high intensity, gas discharge lamp.

BACKGROUND OF THE INVENTION

High intensity, gas discharge luminaires, which are hereinafter referred to as HID luminaires, are commonly installed at high locations at commercial or industrial facilities such as on the ceiling of a warehouse or plant, or on light poles in a parking lot or stadium. HID luminaires can include, but are not limited to, metal halide or MH lamps, and high pressure sodium or HPS lamps. HID luminaires use pulses from a high voltage source such as a starting circuit to ignite the lamp.

In many applications, the HID luminaires can be elevated on the order of thirty feet or more above the floor or ground at a commercial or industrial facility. The elevation of the luminaires makes repair of malfunctioning luminaires inconvenient and time consuming since service personnel must ascend to considerable heights in order to gain access to the luminaires, assess the problem and then repair or replace components of the luminaire. The malfunctioning of an HID luminaire can be attributed to any of a number of problems such as a defective ballast or ballast capacitor, a defective lamp, loss of supply voltage or defective lamp starting circuit, which is hereinafter referred to as an ignitor.

A number of devices exist to facilitate the assessment of a malfunctioning luminaire. For example, U.S. Pat. No. 4,318,031, to Lonseth et al, discloses a visual monitoring device having two indicator lights for indicating the operational conditions of a lamp, a ballast and a starter circuit, as shown in FIG. 1. The first indicator light is provided across the lamp and indicates whether the lamp or the ballast have failed. The second indicator light is driven by a voltage divider circuit comprising resistors connected to the output of the ballast. The starter circuit is connected to a power source, to the ballast, and to the junction between the lamp and a lead-type ballast capacitor, and is configured to provide the lamp with pulses. The pulses are divided by the voltage divider circuit and the resulting pulses are provided to a diode. The resulting pulses are of sufficient voltage to allow the conduction of the diode and storage by a capacitor. Under normal operating conditions of the starter circuit, pulses are stored during each cycle of a 60 Hertz line current. The indicator light operates when thirty pulses are stored or twice a second.

If the indicator light does not blink and the lamp is off, then the starting circuit is malfunctioning. A service person must then interrupt the supply of power to the luminaire and ascend a ladder or use other means to reach the elevated luminaire in order to remove the luminaire from the ceiling or other surface to which it is mounted. Secondly, the luminaire housing must be opened and circuit connections disconnected to remove the malfunctioning starter circuit and replace it with a new starter circuit. As stated previously, these types of repairs are costly in terms of man-hours required to perform the above operations. Further, such repair operations can potentially expose a service person to electric shock if the luminaire housing is opened before line power to the luminaire is terminated for repair purposes. Thus, a need exists for a luminaire which has an ignitor or starting circuit that is connected to the outside of the luminaire housing, as well as an ignitor indicator. The starting circuit can therefore be removed and replaced with relative ease and without having to interrupt power to the luminaire or risk exposure to electric shock.

SUMMARY OF THE INVENTION

The present invention overcomes the deficiencies of existing lamp trouble-shooting and indicator devices and realizes a number of advantages over these existing devices. An HID luminaire is provided which comprises an externally mounted ignitor and ignitor monitoring device. The ignitor monitoring device provides a visual indication of whether or not the ignitor of the lamp in the HID luminaire is functioning. If the lamp is not on and the ignitor and ignitor monitoring device is activated, sufficient open circuit voltage is present to operate the ignitor. The ballast therefore is most likely functioning properly, and power is present to operate the luminaire. A service person can assume that the lamp is defective and can replace the lamp as a first attempt to correct the problem with the luminaire. If the lamp is off and the ignitor and ignitor monitoring device is also not operating, the luminaire is not operating for any of a number of reasons such as a defective ignitor, a defective ballast or ballast capacitor, a defective lamp or loss of supply voltage. A service person can replace the ignitor in a first attempt to repair the luminaire. Replacing the ignitor is the simplest initial repair option since the ignitor is enclosed with the ignitor monitoring device in a housing that is externally mounted on the luminaire. If the ignitor is indeed the problem, the service person has repaired the luminaire without having to disassemble the luminaire which comprises the lamp, the ballast, and other components in a luminaire housing. In addition, the risk of exposing the service person to electrocution via the power supply wires to the luminaire is reduced since the service person did not have to open the luminaire to replace the ignitor. Further, supply voltage to the luminaire did not have to be interrupted by the service person to replace the externally mounted ignitor and ignitor monitoring device.

In accordance with an aspect of the present invention, the ignitor and the ignitor monitoring device are enclosed in an ignitor circuit housing which is externally and removably mounted to the luminaire housing.

In accordance with another aspect of the present invention, the ignitor circuit housing comprises prongs for insertion in a female receptacle on the luminaire. The prongs are connected to the appropriate ballast and lamp in the luminaire.

In accordance with yet another aspect of the present invention, the ignitor circuit housing is provided with three prongs for connecting to a conductor in the luminaire which extends from the secondary of the ballast to the lamp, to a tap on the lamp ballast and to a common line in the luminaire, respectively.

In accordance with still another aspect of the present invention, the receptable for the luminaire and the ignitor circuit housing are configured to operate in a locking-type arrangement. The receptable can be provided with sockets for receiving pronged contacts provided on the base of the ignitor circuit housing.

In accordance with an embodiment of the present invention, the ignitor comprises a pumping capacitor circuit for activating a sidac and SCR gating circuit to provide a high voltage pulse to cold-start or hot-start an HID lamp. The ignitor monitoring circuit is a series circuit comprising a resistor, a light emitting diode (LED) and a diode connected between the output of the SCR and the low side of the pumping capacitor circuit. The ignitor monitoring circuit operates when the SCR operates and therefore when the ignitor is operating to start the lamp.

In accordance with another embodiment of the present invention, the ignitor comprises a resistor and capactor circuit connected to the ballast to transfer energy from the charged capacitor through a portion of the ballast winding to start a lamp. Energy from the capacitor also operates an ignitor monitoring circuit comprising first and second sidacs when the voltage from the capacitor reaches the breakover point of these sidacs. The ignitor monitoring circuit then operates a second capacitor in conjunction with a third sidac by charging through a resistor until the breakdown voltage of the third sidac is reached. When the third sidac conducts, energy from the capacitor is supplied to an LED. The resistor controls the pulse rate of an LED. The ignitor monitoring circuit operates when the first and second sidacs conduct and therefore when the ignitor starts the lamp.

In accordance with still yet another aspect of the present invention, the ignitor circuit comprises a resistor and capacitor circuit connected to the ballast to transfer energy from the charged capacitor through a portion of the ballast winding to start a lamp. Energy from the capacitor also operates an ignitor monitoring circuit comprising first and second sidacs when the voltage from the capacitor reaches the breakover point of the sidacs. When the sidacs conduct in one direction, the ignitor monitoring circuit operates a LED energized by the discharging capacitor. The ignitor monitoring circuit operates when the sidacs conduct and therefore when the ignitor starts the lamp.

BRIEF DESCRIPTION OF THE DRAWINGS

These and other features and advantages of the present invention will be more readily comprehended from the following detailed description when read in connection with the appended drawings, which form a part of this original disclosure, and wherein.

Throughout the drawing figures, like reference numerals will be understood to refer to like parts and components.

DETAILED DESCRIPTION OF THE PREFERRED EMBODIMENTS

Figure 1:
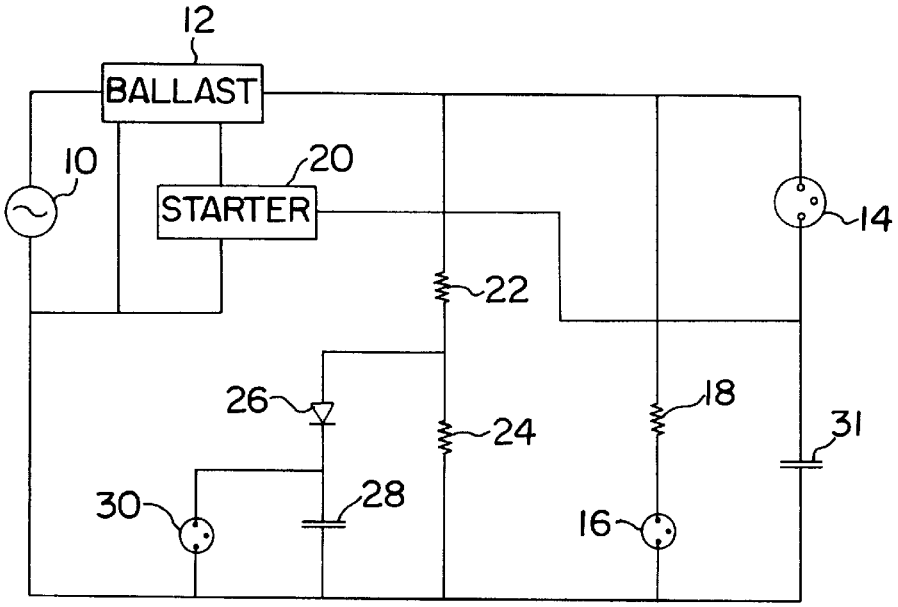
FIG. 1 PRIOR ART
FIG. 1 is an existing circuit for operating an HID lamp having a starter circuit and indicator lights.
Figure 2:
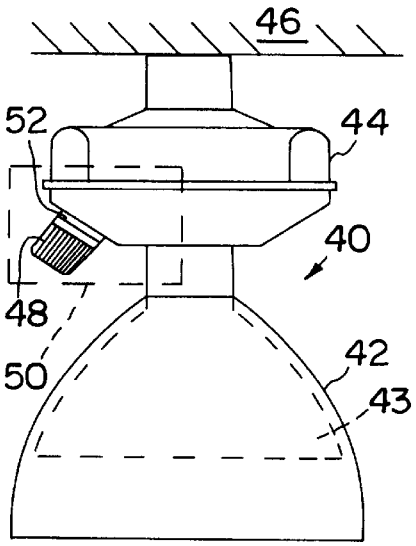
FIG. 2 illustrates a luminaire constructed in accordance with an embodiment of the present invention.

An HID luminaire 40 is depicted in FIG. 2 which has an optical assembly 42 and a luminaire housing 44. The luminaire housing is constructed to be mounted on a ceiling 46 or other surface in a conventional manner. As will be described below in connection with FIG. 8, the luminaire housing encloses a ballast for the lamp 43 contained within optical assembly 42 and other components such as electrical leads (e.g., a hot line, a common line and ground). In accordance with the present invention, an ignitor and indicator circuit 48 is mounted externally with respect to the luminaire housing 44.

Figure 3:
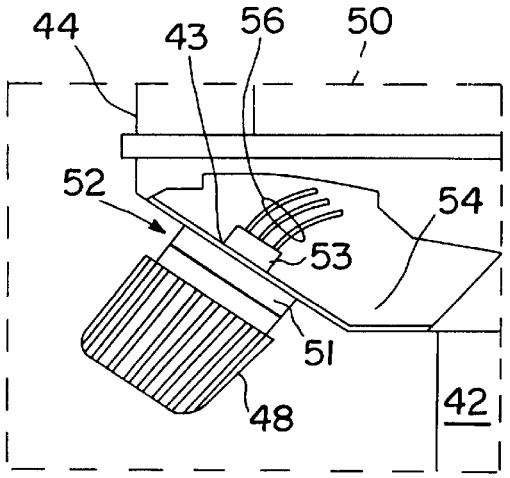
FIGS. 3 and 4 illustrate a portion of a luminaire constructed in accordance with an embodiment of the present invention.
Figure 4:
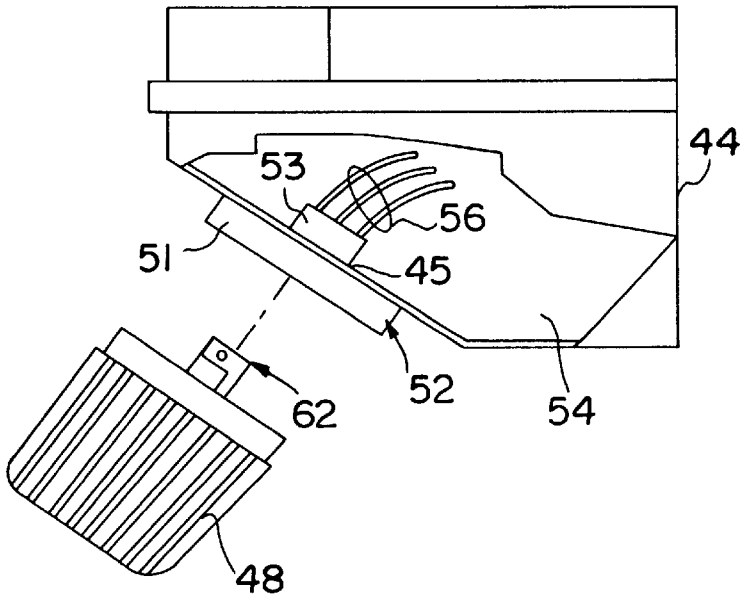
Figure 5:
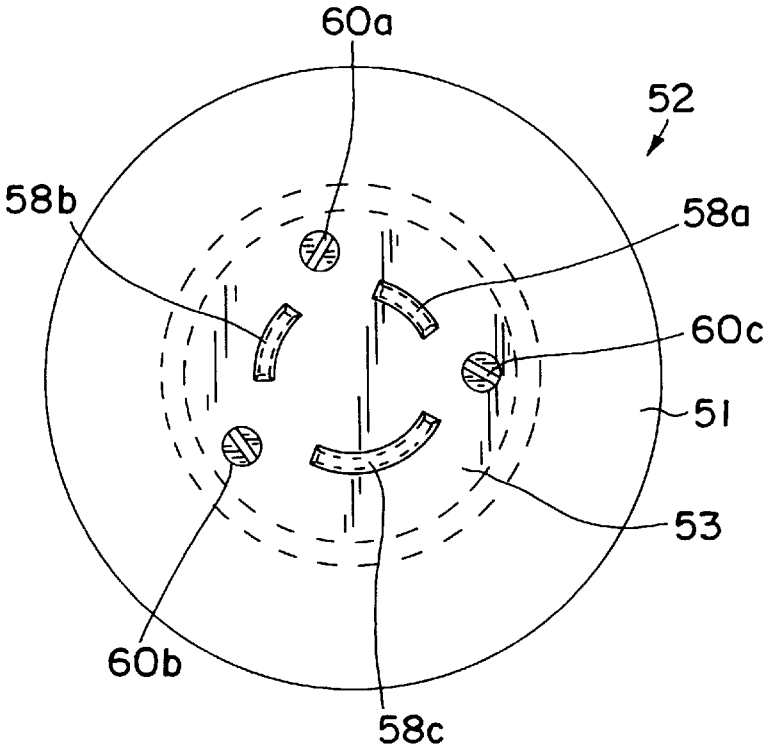
FIG. 5 is a cross-sectional view of a receptacle for an externally mounted ignitor and indicator circuit in a luminaire constructed in accordance with an embodiment of the present invention.

An enlarged view of a portion 50 of the luminaire housing 44, the optical assembly lamp 42 and the ignitor and indicator circuit 48 is shown in FIG. 3. With reference to FIGS. 3, 4 and 5, the luminaire housing 44 is provided with a receptacle or socket 52. The receptable or socket 52 is mounted to the luminaire housing 44 in a conventional manner. For example, the receptacle 52 can comprise a disc-shaped exterior section 51 which abuts the luminaire housing 44 and an interior cylindrical section 53 having a smaller diameter than the exterior section 51. The luminaire housing 44 is provided with an aperture 45 having dimensions to receive the interior section 51 therethrough. The exterior section 51 and the portion of the luminaire housing 44 to which the exterior section is mounted 51 can both be provided with coinciding apertures (not shown) for receiving screws 60*a*, 60*b* and 60*c*, for example, to secure the receptacle 52 to the luminaire housing 44.

Figure 6:
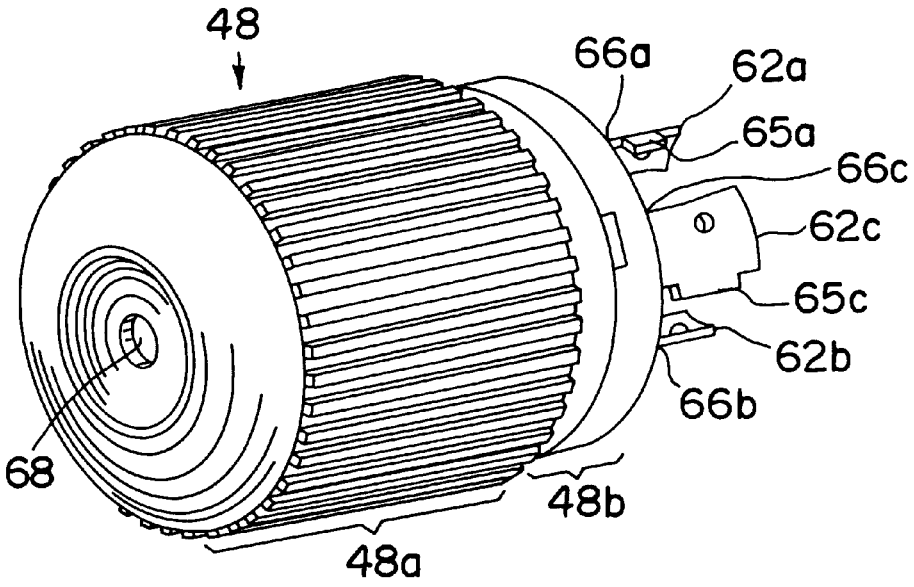
FIG. 6 is a perspective view of ignitor and indicator circuit constructed in accordance with an embodiment of the present invention.
Figure 7:
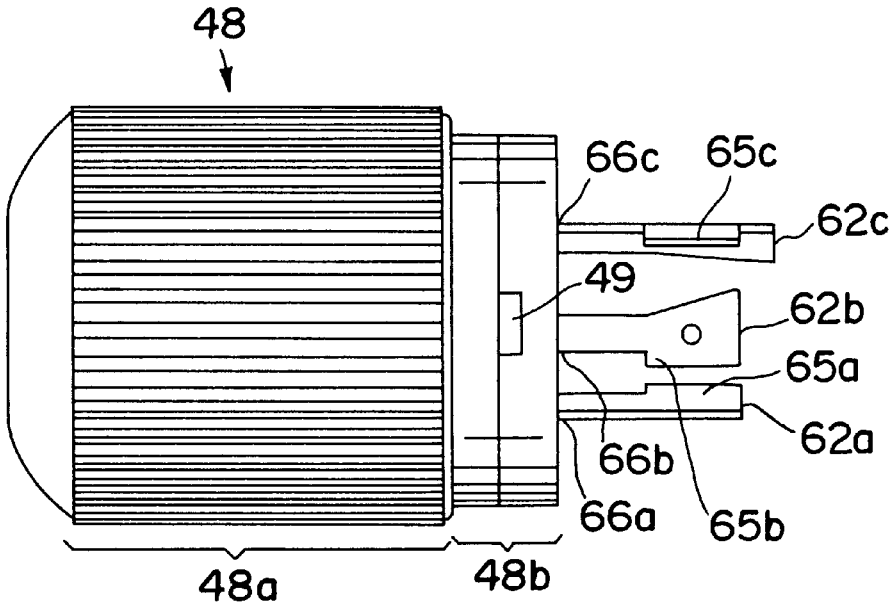
FIG. 7 is a side view of ignitor and indicator circuit constructed in accordance with an embodiment of the present invention.
Figure 8:
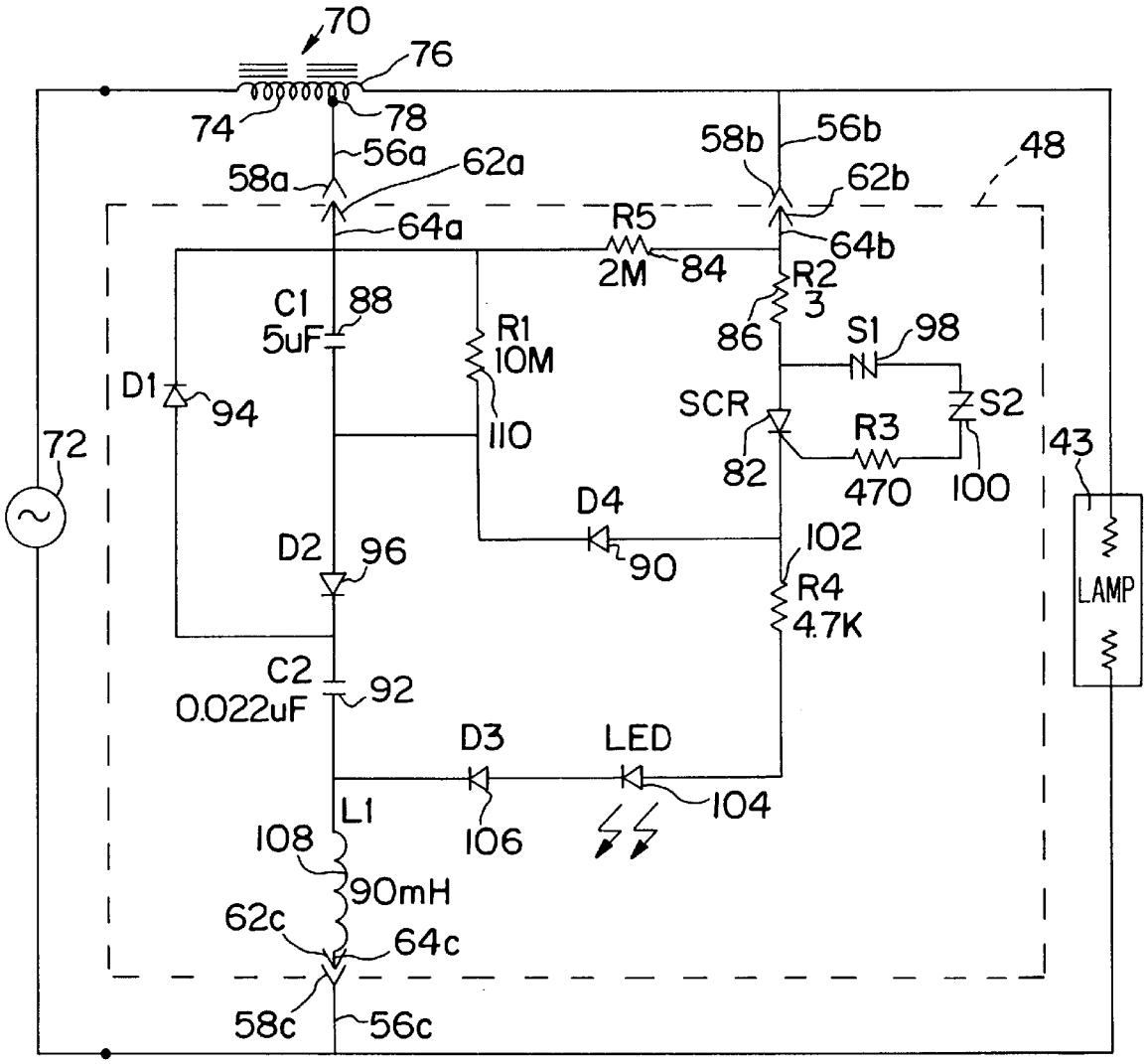
FIGS. 8, 9 and 10 are schematic diagrams illustrating ignitor and indicator circuits constructed in accordance with different embodiments of the present invention.
Figure 9:
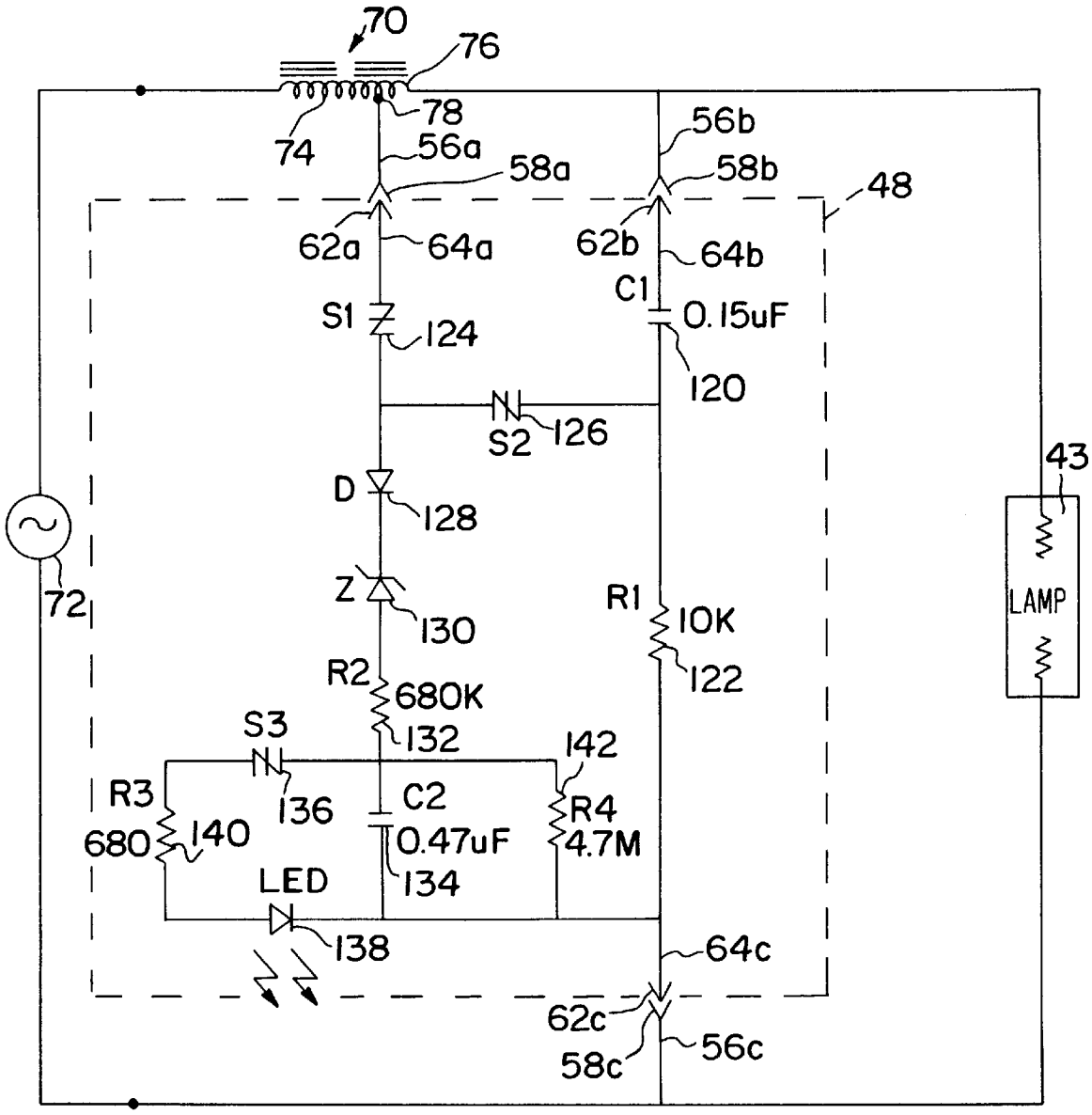
Figure 10:
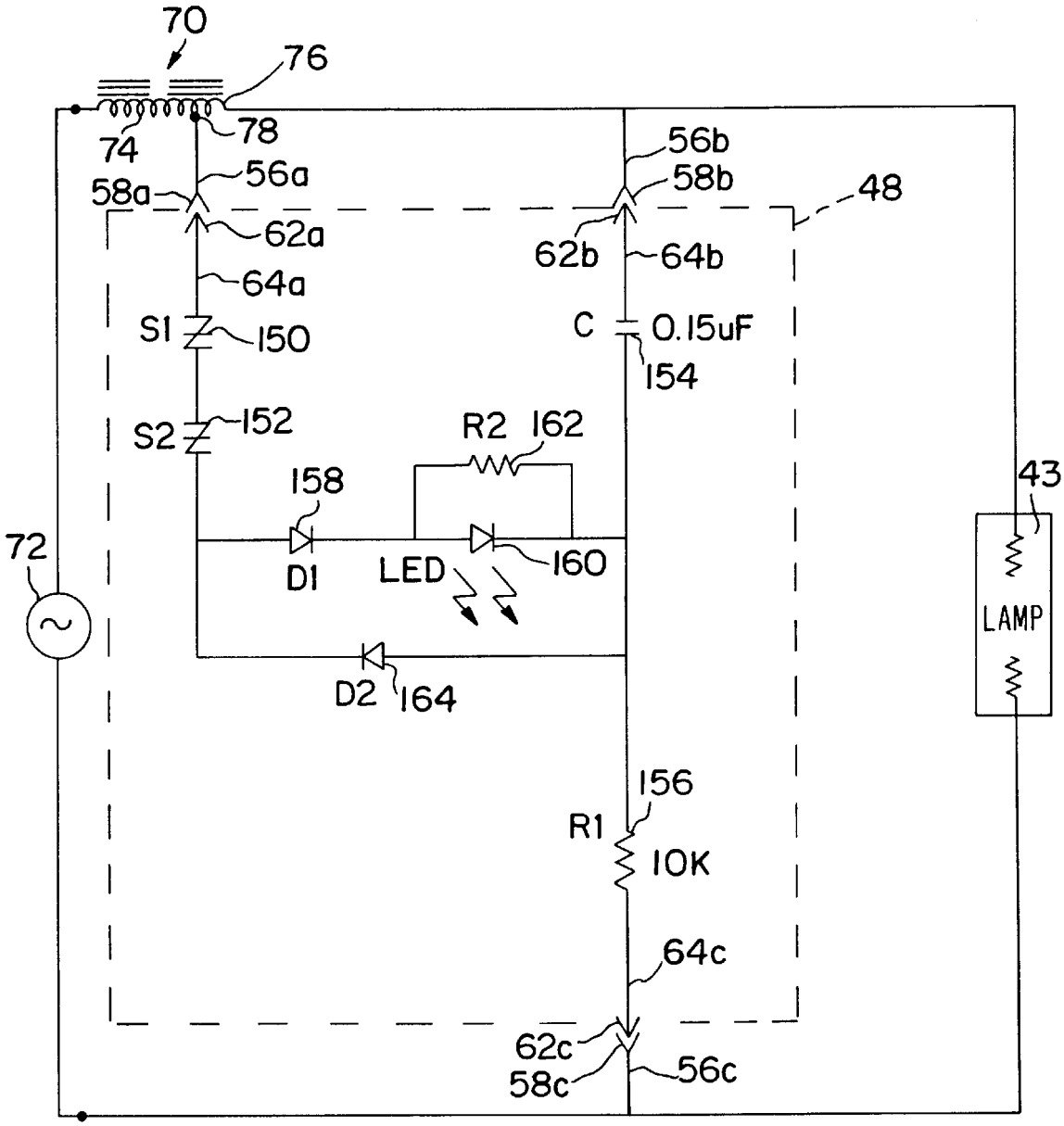

In accordance with an embodiment of the present invention, the receptacle 52 is provided with sockets (e.g., sockets 58*a*, 58*b* and 58*c*) for receiving respective contacts (e.g., 62*a*, 62*b* and 62*c*) provided on the ignitor and indicator circuit 48, as shown in FIGS. 5, 6 and 7. The sockets are electrically connected to respective wires indicated generally at 56 in the interior of the luminaire housing 44, which is indicated at 54 in FIGS. 3 and 4 for illustrative purposes. The luminaire housing 44 is preferably enclosed to protect the ballast, wiring and other components therein. The sockets, which are referred to collectively as sockets 58, can comprise conductive sheaths which extend through the thickness of the exterior portion 51, or through both of the exterior and interior portions 51 and 53, respectively, of the receptable 52. The wires 56 preferably comprise a ballast tap wire 56*a*, a ballast secondary wire 56*b*, and a common or neutral wire 56*c*, as shown in FIGS. 8, 9 and 10. The wires 56*a*, 56*b* and 56*c* are electrically connected to respective ones of the sockets (e.g., sockets 58*a*, 58*b* and 58*c*) in a conventional manner.

With reference to FIG. 4, the ignitor and indicator circuit (IIC) 48 is illustrated as being removed from the receptacle 52 in the partial view of the luminaire housing 44 to illustrate the contacts 62. In accordance with an embodiment of the invention illustrated in FIGS. 6 and 7, the IIC 48 comprises an enclosure having two cylindrical sections 48*a* and 48*b*. The section 48*a* encloses the ignitor components and the ignitor monitoring or indicator components, all of which are described below with regard to alternative embodiments in FIGS. 8, 9 and 10. The sections 48*a* and 48*b* can be formed from a nonconductive material such as plastic, for example. The outer circumference of the section 48*b* can be dimensioned to frictionally engage the inner circumference of the section 48*a* in a conventional manner for a snap fit. A notch 49 is provided in the section 48*b* to receive the end of a screw driver or knife or other tool to facilitate separating the sections 48*a* and 48*b* when desired. Section 48*b* is provided with three apertures through which the contacts 62*a*, 62*b* and 62*c* are inserted for mounting thereto. Wires 64*a*, 64*b* and 64*c* extending from the IIC components, as shown in FIGS. 8, 9 and 10, are electrically connected in a conventional manner to the contacts 62*a*, 62*b* and 62*c*. An opening or window 68 is provided in the housing section 48*a* through which light from an indicator such as a light-emitting diode or LED can be seen.

With continued reference to FIGS. 6 and 7, the contacts 62*a*, 62*b* and 62*c* can be frictionally retained in the sockets 58*a*, 58*b* and 58*c*. In accordance with another embodiment of the present invention, the contacts 62*a*, 62*b* and 62*c* can be configured to have a locking-type connection with the sockets 58*a*, 58*b* and 58*c*, respectively. For example, one or more of the contacts 62*a*, 62*b* and 62*c* can be provided with a tab such as the tabs 65*a* and 65*c* shown in FIG. 6 and the tabs 65*a*, 65*b* and 65*c* shown in FIG. 7. As shown in FIGS. 6 and 7, the bases 66*a*, 66*b* and 66*c* of each of the contacts 62*a*, 62*b* and 62*c* have less width than the distal ends of the contacts due to the tabs 65*a*, 65*b* and 65*c*. The sockets 58*a*, 58*b* and 58*c* can be dimensioned to receive the distal end of respective ones of the contacts 62*a*, 62*b* and 62*c*, including their tabs 65*a*, 65*b* and 65*c*. Since the respective bases 66*a*, 66*b* and 66*c* are smaller, the IIC 48 can be rotated such that one side of each contact at the base 66*a*, 66*b* and 66*c* thereof (i.e., the side of the contact from which the tab 65*a*, 65*b* and 65*c* extends) abuts one side of the corresponding socket 58*a*, 58*b* and 58*c*. Accordingly, the tabs 65*a*, 65*b* and 65*c* prevent the IIC 48 from being separated from the receptacle 52 since the tabs are no longer aligned with the corresponding socket 58*a*, 58*b* and 58*c* by virtue of the rotation of the IIC 48 with respect to the luminaire housing 44.

Exemplary components for the IIC 48 are illustrated in FIG. 8. As stated previously, the luminaire 44 housing preferably encloses a ballast 70. The ballast 70 is electrically connected to a lamp 43 in a conventional manner. Power is provided to the luminaire housing 44 from an alternating current (AC) power source 72 which can supply a line voltage such as 120 volts or 240 volts at 60 Hz, for example. The inductive ballast 70 has one end connected to the line voltage of the AC power source 72. The other end of the ballast 70 is connected to a first terminal of the lamp 43. The second terminal of the lamp is connected via a return path to the AC power source 72. Thus, the ballast 70 and the lamp 43 are in series across the AC power source 72.

The ballast 70 is preferably a tapped ballast having a first winding portion 74 and a second winding portion 76. A tap 78 is provided between the first and second winding portions 74 and 76. A semiconductor switch such as a silicon-controlled rectifier (SCR) 82 or the like is connected such that one end of its switchable and conductive path is connected to the second winding portion 76 of the ballast 70 via resistors 84 and 86. The other end of the SCR 82 is connected to a terminal of a capacitor 88 via a diode 90. The other terminal of the capacitor 88 is connected to the ballast tap 78 via a IIC 48 wire 64*a*, the socket 58*a* and the corresponding wire 56*a* in the luminaire housing 44.

The circuit of the IIC 48 in FIG. 8 provides a high pressure sodium (HPS) lamp ignitor for shortening lamp reignition time at start-up or following a power interruption, and also provides a visual indication of ignitor circuit operation. The operation of the ignitor is similar to that described in U.S. Pat. No. 5,321,338, which is hereby incorporated herein by reference for all purposes. The capacitor 88 is charged in a "stair step" manner by way of a voltage doubling circuit comprising capacitors 88 and 92 and diodes 94 and 96. During one half cycle of the AC power source 72, current flows through a choke 108, the capactor 92 and the diode 94 to charge the capacitor 92. This capacitor is selected to be smaller than the capacitor 88. On the next half cycle, the capacitor 88 is charged and the voltage across the capacitor 92 facilitates the incoming half wave in delivering energy to the capacitor 88. On the next half cycle, the capacitor 92 is again charged and again delivers energy to the capacitor 88 on the subsequent half cycle, thereby increasing the voltage in the capacitor 88 in a kind of voltage multiplying or pumping action.

When the voltage across the capacitor 88 attains a voltage level substantially equivalent to the breakover voltage level of the sidacs 98 and 100 combined, the SCR 82 is turned on. Accordingly, the energy stored in the capacitor 88 is discharged through the portion of the ballast winding indicated at 76. By way of autotransformer action of the ballast 70, this energy is transformed into a high-voltage pulse which is sufficient to either cold-start or hot-start certain HPS lamps (e.g., the lamp 43). The main circuit path for the discharge of the energy stored in the capactor 88 is through the ballast winding, the resistor 86, the SCR 82 and the diode 90. When the SCR 82 is on, the circuit branch comprising the resistor 86, a resistor 102, an indicator such as a light emitting diode (LED) 104, a diode 106 and a radio frequency choke 108 is placed across the output of the ballast 70. The combination of the open circuit voltage and the ignition pulses provides current through the circuit branch containing the LED 104 and therefore through the LED 104. Thus, the operation of the LED 104 is directly related to the operation of the SCR 82 and is therefore an indication that the ignitor circuit is functioning. Resistors 84 and 110 are useful to discharge the energy stored in the capacitors in the event that the IIC 48 is disconnected during operation. The rectifiers 90 and 106 prevent unwanted current from flowing in the circuit branch containing the LED 104. This particular ignitor generates a single ignition pulse every 2 to 5 seconds.

The ignitor circuit shown in FIG. 9 operates in a more conventional manner in that it generates over 100 pulses per second. A capacitor 120 is charged through a resistor 122 until the voltage reaches the breakover level of two sidacs 124 and 126 combined. When the sidacs 124 and 126 conduct, the energy stored in the capacitor 120 is transferred to a portion 76 of the ballast winding in the same manner as described in FIG. 8. When the sidac 124 begins to conduct, current flows in an additional circuit path consisting of a diode 128, a zener diode 130, a resistor 132 and a capacitor 134 which is connected between the ballast tap 78 and the common line 56*c*. The capacitor 134 is charged through the resistor 132 until its voltage reaches the breakover level of a sidac 136. As the sidac 136 conducts, energy stored in the capacitor 134 is transferred to an indicator such as an LED 138 through a resistor 140. A resistor 142 is used in conjunction with the zener diode 130 to control the charge rate of the capacitor 134 and therefore the LED pulse frequency. The diode 128 is used to prevent reverse current flow when the ballast open-circuit voltage reverses polarity. The zener diode 130 can be omitted, depending upon ballast open-circuit voltage and desired LED pulse frequency.

FIG. 10 shows an ignitor circuit which is a less complex version of the circuit described in FIG. 9. The basic ignition operation is the same as previously discussed; however, when the sidacs 150 and 152 conduct the current resulting from the discharging of the capacitor 156, which has been charged through resistor 154, flows through a diode 158 and an indicator such as an LED 160 or a diode 164. The diode 158 is used to prevent reverse current from flowing through the LED 160 since the blocking voltage rating of the LED is low. The diode 164 is used as a current bypass around the LED branch in the reverse direction. As a result of this arrangement, the LED 160 only illuminates when the open-circuit voltage is positive with respect to the ballast common. Since there is no long time constant associated with this circuit, the LED 160 illuminates with the same frequency as the starter pulses on the positive half cycle which gives the appearance to the naked eye as being on constantly during ignitor operation.

The HID luminaire of the present invention is advantageous because it is provided with an externally mounted ignitor and ignitor monitoring device, that is, an IIC 48. The ignitor monitoring device provides a visual indication of whether or not the ignitor of the lamp in the HID luminaire is functioning. The ignitor can be, for example, any of the circuits described above in connection with FIGS. 8–10 for cold-starting or hot starting the lamp 43. If the lamp 43 is not on and the LED of the IIC 48 is activated, this indicates that sufficient open circuit voltage is present to start and lamp 43 operate the 43. A service person can assume that the lamp 43 is defective and can replace the lamp 43 as a first attempt to correct the problem with the luminaire 40. If the lamp 43 is off and the LED of the ignitor ad the ignitor monitoring device (i.e., the IIC 48) is also not operating, this indicates that the lamp 43 is not operating for any of a number of reasons such as a defective ignitor, a defective ballast 70 or ballast capacitor (not shown), a defective lamp 43 or loss of supply voltage from the power source 72. A service person can replace the ignitor in a first attempt to repair the luminaire 40. Replacing the ignitor is the simplest initial repair option since the ignitor is enclosed with the ignitor monitoring device (e.g., IIC 48) in a housing (e.g., sections 48*a* and 48*b*) that is externally mounted on the luminaire 40. If the ignitor is indeed the problem, the service person has repaired the luminaire 40 without having to disassemble the luminaire which comprises the lamp, the ballast, and other components in a luminaire housing 44. In addition, the risk of exposing the service person to electric shock via the supply wires to the luminaire to replace the ignitor. Further, supply voltage to the luminaire did not have to be interrupted by the service person to replace the externally mounted ignitor (e.g., the IIC 48).

The luminaire 40 of the present invention has been described as having three sockets for connecting to three contacts in an IIC 48. One of the contacts 62*c* and its corresponding socket 58*c* are configured to be larger than the other contact and socket pairs 62*a* and 58*a*, and 62*b* and 58*b*, respectively, to facilitate alignment of the IIC 48 to the receptable 52 for connection of each contact 62*a*, 62*b* and 62*c* to the appropriate one of the sockets 58*a*, 58*b* and 58*c*. It is to be understood that the IIC 48 and the receptacle 52 and luminaire 40 can be constructed with fewer or additional contacts 62 and sockets 58 than the illustrated embodiment. In addition, the electrical connections of the IIC 48 to different points in the luminaire housing (44 e.g., via wires 56*a*, 56*b* and 56*c*) can be changed depending on the ignitor. Also, the receptacle 52 can be provided with prongs connected to the wires 56*a*, 56*b* and 56*c* in lieu of the sockets 58*a*, 58*b* and 58*c*. Accordingly, the IIC housing 48 can be configured with a female connector for receiving the prongs on the receptacle 52. The female connector is connected to the wires 64*a*, 64*b* and 64*c*, respectively.

While certain advantageous embodiments have been chosen to illustrate the invention, it will be understood by those skilled in the art that various changes and modifications can be made therein without departing from the scope of the invention as defined in the appended claims.

What is claimed is:

1. An ignitor and ignitor monitoring device for a luminaire having a ballast and a discharge lamp, the luminaire being supplied with power from a power source, the ignitor and ignitor monitoring device comprising:

a receptacle connected to said luminaire, said receptacle having receptacle contacts which are electrically connected to path connections in said luminaire, said path connections being selected from the group consisting of a tap on said ballast, the secondary winding of said ballast, and a common line extending from said lamp to said power source;

an ignitor for generating pulses to start said lamp;

an indicator connected to said ignitor and operable to indicate when said ignitor is generating said pulses; and a housing for enclosing said ignitor and comprising said indicator, removably coupled to said luminaire, said housing having housing contacts which are electrically connected to said ignitor, said housing contacts being removably and electrically connected to said receptacle contacts, said ignitor being operable to receive power from said power source and to provide said pulses to said lamp using said ballast when said housing contacts are connected to respective said receptacle contacts, said indicator being operable to indicate operation of said ignitor when said housing is connected to respective said receptacle contacts.

2. An ignitor and ignitor monitoring device as claimed in claim 1, wherein said housing is externally mounted to said luminaire.

3. An ignitor and ignitor monitoring device as claimed in claim 1, wherein one of said receptacle and said housing comprises sockets connected to the respective ones of the corresponding said receptable contacts and said housing contacts, and the other one of said receptacle and said housing comprises prongs connected to respective ones of the corresponding said first contacts and said housing contacts, said sockets being configured to receive respective said prongs therein.

4. An ignitor and ignitor monitoring device as claimed in claim 3, wherein at least one of said prongs is provided with tab at the distal end thereof, said tab extending laterally from the longitudinal axis of said prong, at least one of said sockets being configured to accept said distal end of said prong having said tab, said receptacle being configured to retain said prongs in said sockets via said tab when said housing is moved with respect to said receptacle and said tab is no longer aligned with the corresponding one of said sockets.

5. An ignitor and ignitor monitoring device as claimed in claim 4, wherein said prongs are arranged in a circular configuration, and said sockets are arranged in a corresponding said circular configuration, said housing being retained in said receptacle when said prongs are inserted in said sockets by rotating said housing with respect to said receptacle.

6. An ignitor and ignitor monitoring device as claimed in claim 1, wherein said indicator is a light emitting device connected to said housing such that said light is visible externally with respect to said housing.

7. An ignitor and ignitor monitoring device as claimed in claim 1, wherein said ignitor circuit comprises a capacitive pulsing circuit for generating pulses through at least a portion of said ballast to start said lamp, said indicator being connected to said capacitive pulsing circuit, said housing contacts being connected to said capacitive pulsing circuit and to a common path for connection to said common line via a corresponding one of said receptacle contacts.

8. An ignitor and ignitor monitoring device as claimed in claim 7, wherein said capacitive pulsing circuit comprises a gated device connected to a capacitor, said gated device being turned on to pulse said lamp when said capacitor stores a voltage across the terminals thereof which exceeds an activation voltage corresponding to said gated device, said indicator being connected between the output of said gated device and said common path.

9. An ignitor and ignitor monitoring device as claimed in claim 7, wherein said ballast comprises a tap, said capacitive pulsing circuit comprises three terminals connected, respectively, to said tap, to the secondary winding of said ballast, and to said common path, said housing comprising three of said housing contacts to connect to respective said terminals, said receptacle having three of said receptacle contacts, said receptacle and said housing comprising three of a corresponding one of said prongs and said sockets.

* * * * *